United States Patent [19]

Peterson et al.

[11] Patent Number: 4,895,059

[45] Date of Patent: Jan. 23, 1990

[54] ADJUSTABLE BACK GAUGE SUPPORT DEVICE

[76] Inventors: Walter J. Peterson, 15125 Lincoln St., Lake Elsinore, Calif. 92330; William L. Bennett, 1240 Deventer Dr., La Verne, Calif. 91750

[21] Appl. No.: 330,001

[22] Filed: Mar. 29, 1989

[51] Int. Cl.[4] ..... B26D 7/01

[52] U.S. Cl. ..... 83/468.7; 83/581; 269/303

[58] Field of Search ..... 83/467 R, 467 A, 468, 83/581, 207, 268, 391–395; 269/303, 304, 315

[56] References Cited

U.S. PATENT DOCUMENTS

| | | | |
|---|---|---|---|
| 1,058,964 | 4/1913 | Gray, Jr. . | |
| 2,125,539 | 8/1938 | Brownlee . | |
| 2,238,857 | 4/1941 | Ford . | |
| 3,056,325 | 10/1962 | Hart . | |
| 3,470,778 | 10/1969 | Mohr . | |
| 3,854,214 | 12/1974 | Crocket | 33/80 |
| 4,002,329 | 1/1977 | Petrowski | 269/318 |
| 4,033,572 | 7/1977 | Cailloux | 269/320 |
| 4,577,538 | 3/1986 | Hirata et al. | 83/467 R |
| 4,747,330 | 5/1988 | Carithers, Jr. | 83/467 A |

FOREIGN PATENT DOCUMENTS

| | | | |
|---|---|---|---|
| 591314 | 2/1978 | U.S.S.R. | 83/467 R |

*Primary Examiner*—Douglas D. Watts
*Assistant Examiner*—Eugenia A. Jones
*Attorney, Agent, or Firm*—Nilsson, Robbins, Dalgarn, Berliner, Carson & Wurst

[57] ABSTRACT

Apparatus for varying the angle at which a stack of paper is cut by a conventional paper shear has a base mountable to a back gauge of the shear and a movable element carried by the base for relative sliding movement between a plurality of operative positions. The movable element has a rib or other surface portion engageable with an edge of a stack of paper for orienting the edge at a different angle to a cutting blade in each operative position of the apparatus. The movable element preferably slides between a continuous range of operative positions and can be secured in any one of the positions.

15 Claims, 3 Drawing Sheets

FIG. 1
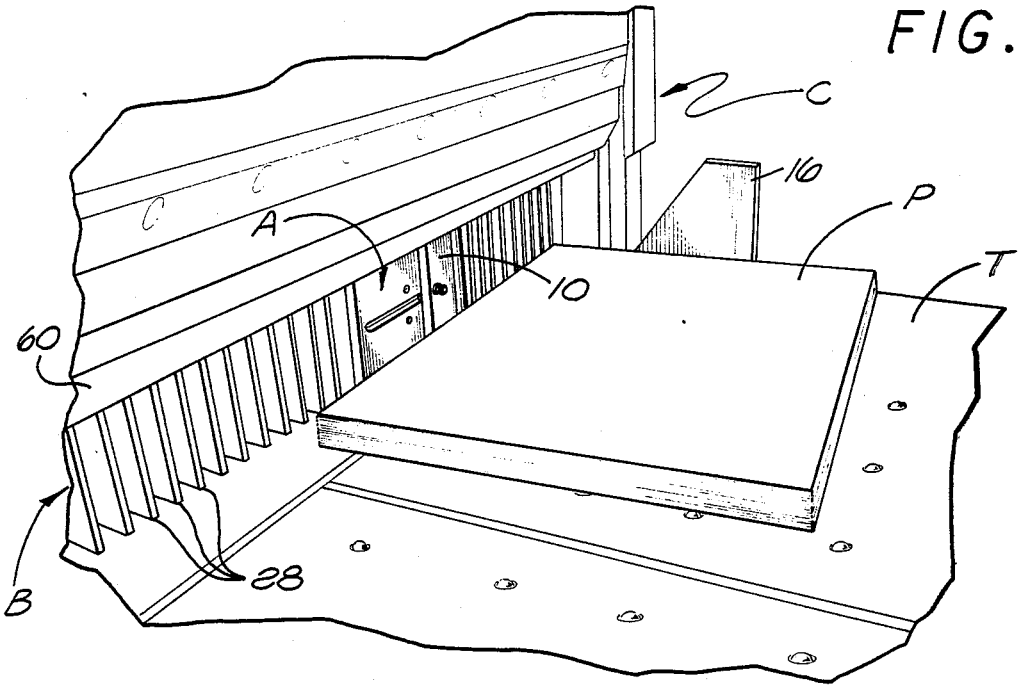
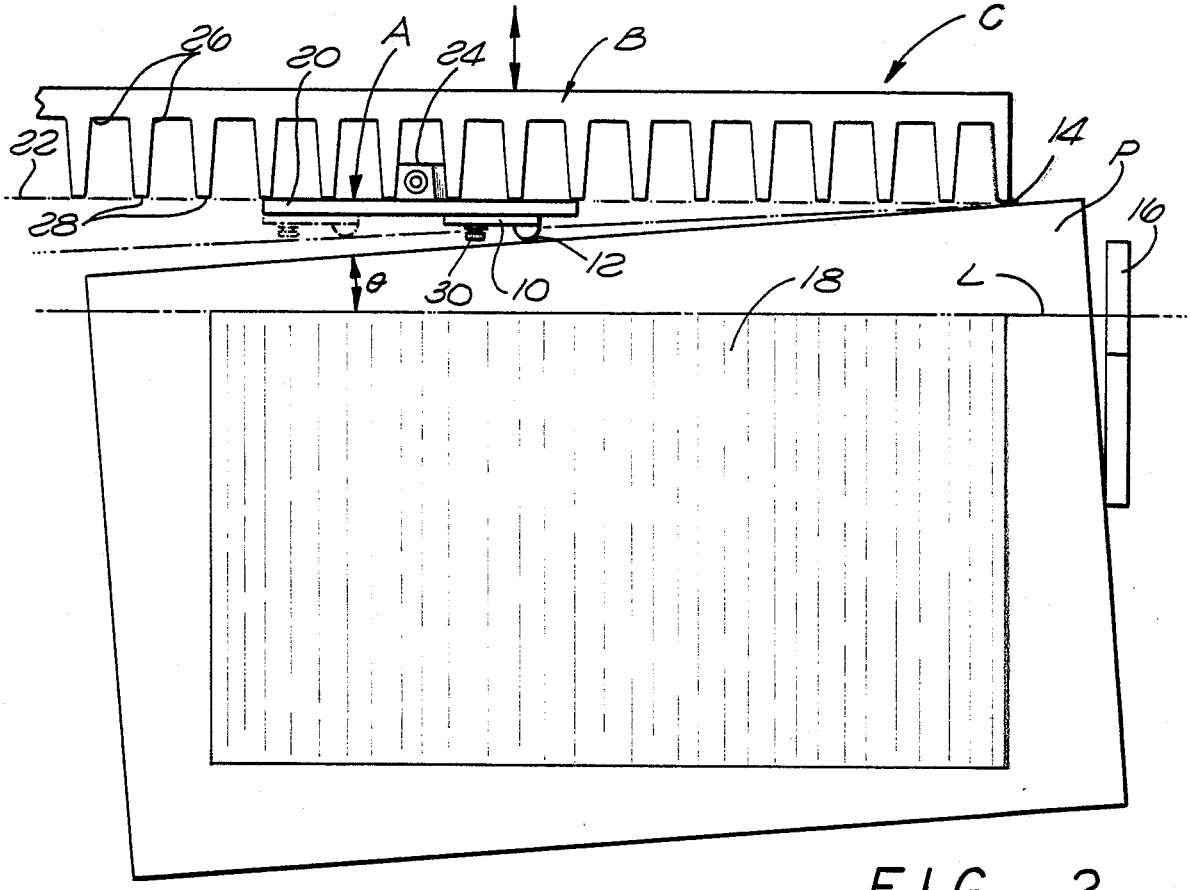
FIG. 2

ADJUSTABLE BACK GAUGE SUPPORT DEVICE

BACKGROUND OF THE INVENTION

The present invention relates to an apparatus for varying the angle at which sheet stock is cut and, more particularly, to an adjustable device for varying the angle at which paper is supported relative to the back gauge and blade of a commercial paper cutter.

Images which vary in intensity from one location to another are printed by applying ink to a surface in a nonuniform manner. To do so, ink must be drawn at different rates from different points along an inking roller. This upsets the even distribution of ink on the inking roller and, in extreme cases, can temporarily reduce the supply of ink at some locations below that required for faithful reproduction of the image. The result is a localized reduction in image intensity, known as "ghosting", which can reduce or destroy the value of the finished product.

It is known that the problem of ghosting can be drastically reduced by tilting an image relative to the direction of paper travel in the printing process; however, the resulting page is difficult to cut on commerical paper cutters because borders of the image are oblique to the edges of the paper. Most commercial paper cutters are heavy instruments in which a thick stack of paper is held against a back gauge and cut by a blade parallel to the back gauge. An early cutter of this type is disclosed in U.S. Pat. No. 1,058,964 to Gray, Jr. Modern cutters are power driven and have back gauges movable automatically in a direction perpendicular to the blade, with the back gauge typically remaining parallel to the blade. Such machines are not easily adapted to vary the angle of cut from the built-in parallel condition in a controlled manner.

A technique commonly used to vary the angle of cut in machines of this type is to place a block of wood behind one end of a stack of paper and move the block until the paper is aligned. This method is crude, however, and requires manual realignment between successive cuts to the same stack of paper. Each cut must be aligned with a different set of marks a few thousandths of an inch wide.

Shears foro cutting paper and other forms of sheet stock have, in some cases, been provided with back gauge mechanisms capable of adjustment to vary the angle of cut. Such machines are disclosed in the following U.S. patents: U.S. Pat. No. 2,125,539 to Brownlee; U.S. Pat. No. 3,470,778 to Mohr; U.S. Pat. No. 4,033,572 to Cailloux; and, U.S. Pat. No. 4,577,538 to Hirata et al. Each of these mechanisms is rather complex, however, and the disclosed structures are not easily adapted to existing fixed angle machines.

Therefore, it is desirable in many applications to provide a simple and reliable apparatus for varying the angle at which a stack of paper is cut by a commercial paper cutter having a back gauge parallel to a cutting blade.

SUMMARY OF THE INVENTION

The apparatus of the present invention is a simple and inexpensive device which can be mounted to the back gauge of a commercial paper cutter to vary the angle at which a stack of paper is cut. The device is mountable at any desired location along the back gauge and can be adjusted easily over a wide range to vary the amount by which the paper is skewed relative to a cutting blade.

Adjustment is made by loosening a thumb screw and sliding a movable element of the device along the paper to rotate the paper until a border of its printed region is aligned with the cutting blade. During this process, an adjoining edge of the paper is pressed against a perpendicular side guide of the cutter. The side guide helps hold the stack in the aligned condition while the first cut is made and facilitates realignment to cut adjoining edges.

In another embodiment, the device is mounted to the back gauge or the cutter by a cam-type fastening mechanism which forces cam segments outwardly against adjoining fingers of the back gauge when an axial screw is tightened. This facilitates movement of the device between locations on the back gauge, enhancing its versatility and the range of possible adjustment.

Accordingly, the present invention comprises an apparatus for varying the angle at which a stack of paper is cut by a paper cutter having a flat cutting surface, a cutting blade disposed above the cutting surface and actuable downwardly thereagainst, a back gauge parallel to the cutting blade, and a side guide perpendicular to the cutting blade, the apparatus comprising: a base mountable to the back gauge; a movable element carried by the base for relative sliding movement between a plurality of operative positions, the movable element having a primary surface portion engageable with an edge of a stack of paper for orienting the edge at a different angle to the cutting blade in each of the operative positions; and, means for releasably securing the movable element in a desired one of said operative positions to cut the stack of paper at a preselected angle.

BRIEF DESCRIPTION OF THE DRAWINGS

The above and other features of the present invention may be more fully understood from the following detailed description, together with the accompanying drawings, wherein similar reference characters refer to similar elements throughout and in which:

FIG. 1 is a fragmentary perspective view of a commercial paper cutter which carries an adjustable back gauge support device constructed according to a preferred embodiment of the present invention;

FIG. 2 is a fragmentary top plan view of the paper cutter and back gauge support device of FIG. 1, with the upper portion of the paper cutter omitted for clarity;

DESCRIPTION OF THE PREFERRED EMBODIMENT

Figure 3:
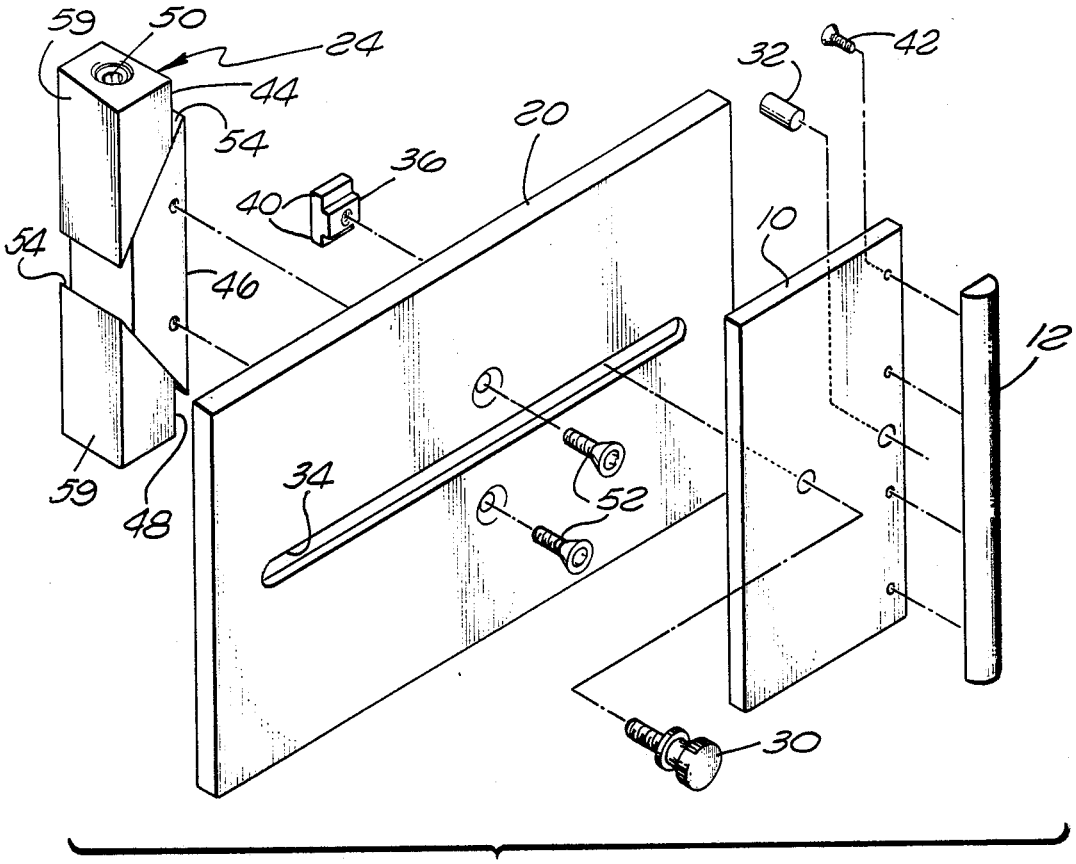
FIG. 3 is an exploded isometric view of the back gauge support device of FIG. 1.

Referring now to the drawings, specifically FIGS. 1 and 2, an adjustable back gauge support device A constructed according to a preferred embodiment of the present invention is mounted to a commerical paper cutter C to skew or tilt a stack of paper P so that a cut can be made at an angle $\Theta$ to the edge of the stack. The support device A is mounted in an upright condition against the forward surface of a movable back gauge B and is positionable at any point along the back gauge to vary the angle Θ. The angle is "fine tuned" by moving a slider element 10 of the support device to produce a cut of any desired angle. The approximate limits of movement of the slider element 10 for a given position of the device A are indicated in FIG. 2 by the full-line and phantom-line positions of the slider element.

In each condition of adjustment, the stack of paper P is positioned on a table T of the paper cutter with the rear edge of the stack contacting a vertical rib 12 of the device A and an end 14 of the back gauge B. An adjoining edge of the stack is supported by one end of a side guide 16 of the paper cutter to locate the stack on the table T and hold it in position until the desired cut can be made.

Since the paper cutter C cuts along a line L which is parallel to the front surface of the back gauge B, the angle of cut achieved with the support device of the present invention depends on the position of the support device along the back gauge B and the position of the slider 10 along the support device. The angle Θ between the cutting line and the edge of the stack of paper can be adjusted to cut the paper precisely along one of the borders of the image 18 printed on the paper. When the printed image 18 and the stack of paper are both rectangular, all four edges of the stack can be cut with a single setting of the support device A. The only adjustment required for successive cuts is movement of the back gauge B in a front-to-back direction to account for any differences in border width. The support device moves forward and backward with the back gauge without varying the angle of cut.

FIG. 2 illustrates the structure of the support device A and how it engages the back gauge B of the paper cutter in use. The support device comprises a base 20 which supports the slider element 10 for lateral sliding movement. The base 20 is held against a forward surface 22 of the back gauge by a fastening mechanism 24 receivable within one of a plurality of recesses 26 formed by forwardly extending fingers 28 of the back gauge. The fastening mechanism 24 anchors the support device to the back gauge B so that it retains its relative position as the back gauge moves.

Figure 4:
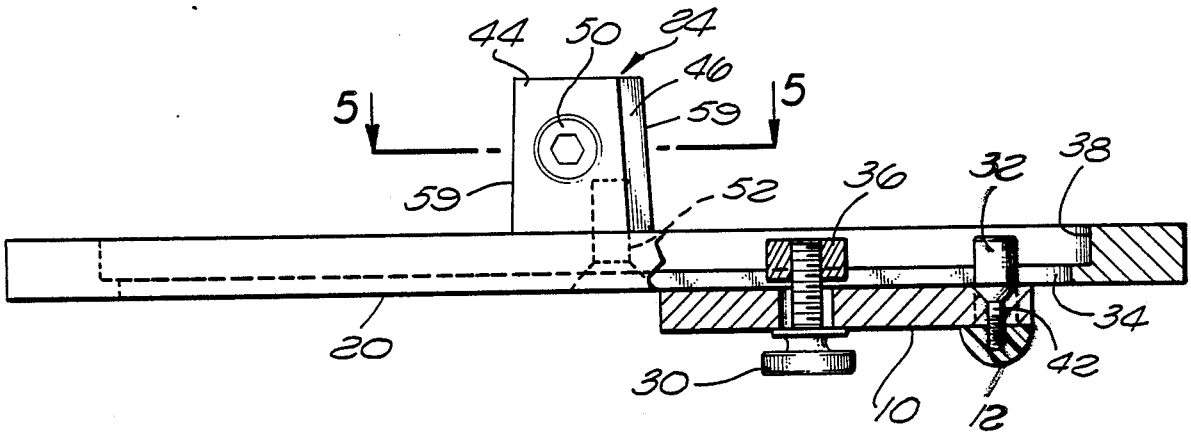
FIG. 4 is a top plan view of the support device of FIG. 1 which is broken away on the right side to reveal a horizontal sectional view taken in a plane containing a central slot of the support device.

As shown most clearly in FIGS. 3 and 4, the slider element 10 is mounted for horizontal sliding movement relative to the base 20 by a thumb screw 30 and a guide pin 32 which are carried by the slider element and extend through a horizontal slot 34 of the base. The thumb screw 30 and the guide pin 32 are spaced apart laterally along the slider element to prevent cocking of the slider element relative to the base. The thumb screw engages a nut 36 to hold the slider element in a desired operative position. The base 20 preferably has an undercut groove 38 (see FIGS. 5 and 6) which surrounds the slot 34 to receive a pair of opposed shoulders 40 of the nut 36. Interaction of the shoulders 40 with the groove 38 permits the nut 36 to slide along the groove with the thumb screw 30 but restrains it from rotating as the thumb screw 30 is tightened. Thus, the thumb screw 30 and the sliding nut 36 combine to secure the slider element 10 in a desired operative position by turning the thumb screw from the front side of the support device A. The adjustment can be changed by loosening the thumb screw and sliding the slider element to a new operative position.

As described above, the support device A contacts the stack of paper P along a vertical rib 12 of the slider 10. The rib 12 is the primary paper-supporting element of the device A and must be capable of withstanding repeated physical contact. In a preferred embodiment, it is formed of a suitable wear resistant material, such as acrylic resin or other synthetic polymeric material, and is rigidly secured to the slider 10 by screws 42 or other means. Alternatively, the rib 12 may be formed integrally with the slider element 10. In either case, the rib may have any shape suitable for holding the stack of paper P in position but is preferably curved in cross section to minimize wear.

Figure 6:
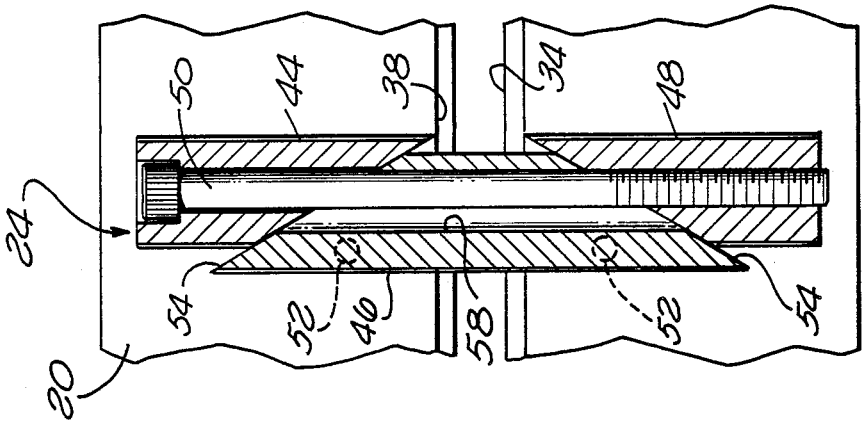
Figure 5:
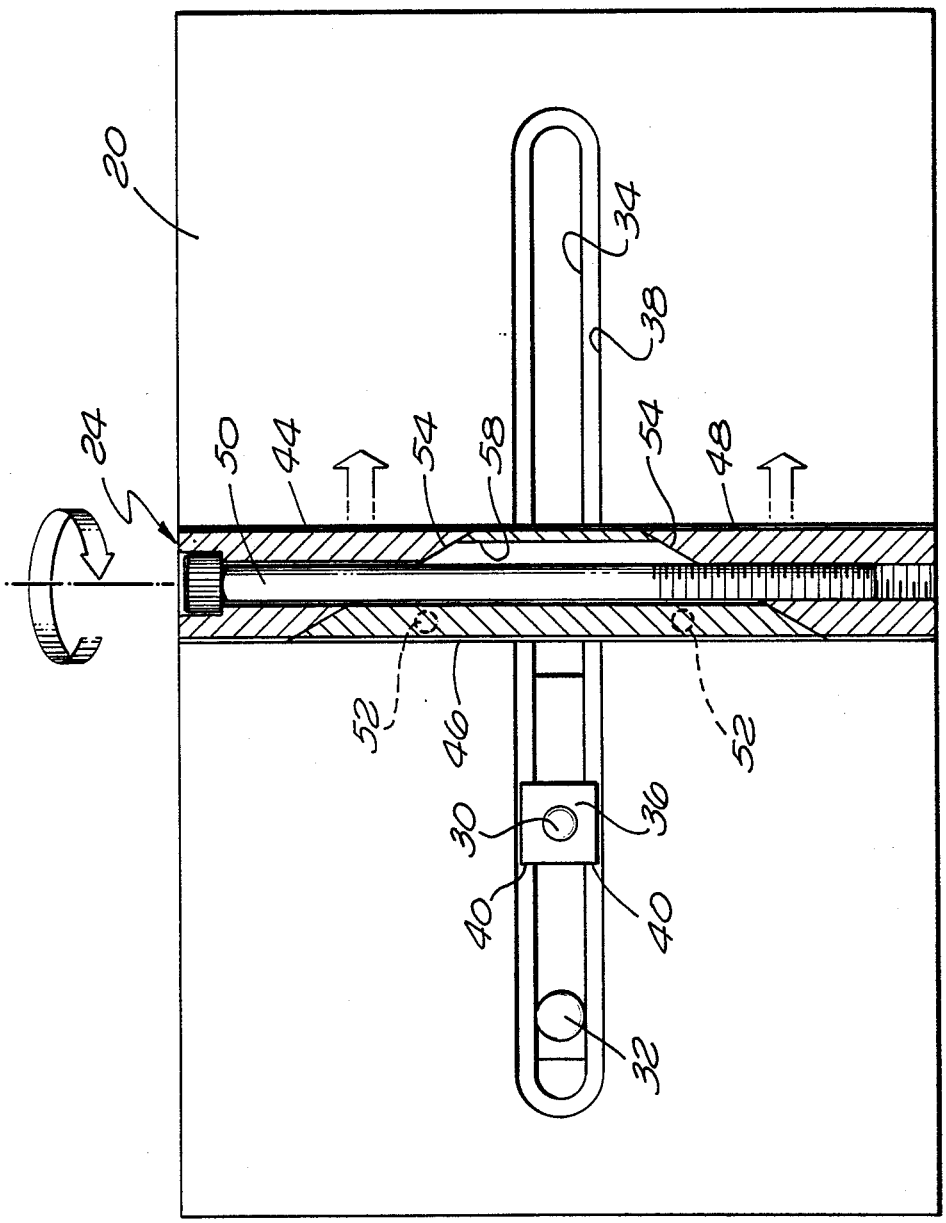
FIG. 5 is a vertical sectional view taken in the direction 5—5 of FIG. 4; and, FIG. 6 is a fragmentary vertical sectional view of the structure of FIG. 5, showing the fastening mechanism of the device in an extended condition thereof.

Referring now specifically to FIGS. 3, 5 and 6, a preferred form of the fastening mechanism 24 consists of cam segments 44, 46 and 48 connected by a screw 50 to form a mechanism which increases in overall width as the screw 50 is tightened. The middle segment 46 is secured rigidly to the back of the base 20 by a pair of screws 52 and is cut along a bias at its upper and lower surfaces 54 to engage oppositely directed surfaces of end segments 44 and 48. The screw 50 extends axially through the upper segment 44, through an enlarged bore 58 of the middle segment 46 (see FIGS. 5 and 6) and threads into the lower segment 48. Advancement of the screw 50 thus pulls the segments 44 and 48 together, camming them laterally against the fingers 28 of the back gauge B (FIG. 1). FIG. 5 shows the retaining means 24 in an initial retracted condition and FIG. 6 shows the same mechanism in a fully actuated condition wherein its overall width is at a maximum.

Referring now to FIGS. 2 and 4, the three segments of the fastening mechanism 24 have tapered sides surfaces 59 which match the tapered recesses 26 between the fingers 28 of the back gauge. The amount of taper depends on the taper of the recesses 26, which is approximately one and one-half degrees for many commercial paper cutters.

In operation, a stack of paper P is arranged on the table T of a commercial paper cutter so that the cutting line L essentially coincides with the border of an image 18 printed on the paper. Once this is achieved, the support device A is positioned within the particular recess 26 of the back gauge B which places the vertical rib 12 nearest the edge of the paper. The support device is then held against the forward surface 22 of the back gauge B as the screw 50 is tightened to cam the segments of the retaining mechanism 24 against the side walls of the fingers 28. The slider element 10 is then moved so that its vertical rib 12 abuts the stack of paper in the desired aligned condition. The thumb screw 30 is then tightened to hold the slider element in place and the stack of paper is ready to be cut. Cutting is accomplished by actuating the cutter C to move a clamp bar 60 downwardly against the paper to hold it in place and drive a cutter blade (not shown) downwardly to make the cut. The stack of paper is then rotated ninety (90) degrees in a counterclockwise direction so that a second edge can be cut, whereupon it may be necessary to move the back gauge B forward or backward to align the blade with the printed image. As noted above, the only adjustment required at this point is forward and backward movement of the back gauge because the angle of the cut relative to the edge of the paper is the same as that provided for by the previous adjustment of the support device A.

From the above, it can be seen that the adjustable support device of the present invention permits a stack of paper to be aligned accurately and reproducibly for cutting at an angle to the edge of the stack on a cutter having a back gauge constrained to remain parallel with the plane of the blade.

The appended claims are not limited to the embodiments described herein, but rather are intended to cover all variations and adaptations falling within the true scope and spirit of the present invention.

What is claimed is:

1. Apparatus for varying the angle at which a stack of paper is cut by a paper cutter having a flat cutting surface, a cutting blade disposed above the cutting surface and actuable downwardly thereagainst, a back gauge parallel to the cutting blade, and a side guide perpendicular to the cutting blade, the apparatus comprising:

a base mountable to the back gauge;

a movable element carried by the base for relative lateral movement between a plurality of operative positions, the movable element having a primary surface portion engageable with an edge of a stack of paper for orienting the edge at a different angle to the cutting blade in each of said operative positions; and, means for releasably securing the movable element in a desired one of said operative positions to cut the stack of paper at a preselected angle.

2. The apparatus of claim 1 wherein:

the base is a plate mountable to the back gauge in a vertical condition; and, the movable element is mounted to the base for sliding movement in a substantially horizontal direction between said operative positions.

3. The apparatus of claim 2 wherein:

the operative position of the movable element is variable continuously within a preselected range.

4. The apparatus of claim 3 wherein:

the securing means is a screw thread mechanism.

5. The apparatus of claim 4 wherein:

the base has a slot extending in a substantially horizontal direction; and the movable element has at least one projection received within said slot to guide the movable element between said operative positions.

6. The apparatus of claim 5 wherein:

the screw thread mechanism includes a screw extending through the movable element and said slot to engage a nut associated with the base; and the base has an undercut portion adjacent the slot for guiding the nut as the movable element moves between said operative positions.

7. The apparatus of claim 2 wherein:

the primary surface portion of the movable eleme comprises a vertical rib engageable with the ed of a stack of paper to support the stack in a late direction.

8. The apparatus of claim 7 wherein:

the vertical rib of the movable element is substantial rigid.

9. The apparatus of claim 8 wherein:

the vertical rib of the movable element comprises synthetic polymeric material.

10. The apparatus of claim 9 wherein:

said synthetic polymeric material is an acrylic resi

11. The apparatus of claim 1 for use with a pap cutter in which the back gauge is movable and has plurality of forwardly directed fingers to support edge of a stack of paper to be cut, wherein the apparat further comprises:

a fastening mechanism associated with the base a receivable between the fingers of a back gauge mount the base to the back gauge.

12. The apparatus of claim 11 wherein:

the fastening mechanism comprises a plurality segments engaging each other in a camming re tionship and joined by a fastener screw thre means to force at least one of the segments lateral against the fingers of the back gauge when t fastener screw thread means is advanced in a pre lected direction.

13. The apparatus of claim 12 wherein:

the segments of the fastening mechanism engage ea other along complementary camming surfaces d posed obliquely to said preselected direction advancement.

14. The apparatus of claim 13 wherein:

said segments comprise:

a middle segment rigidly attached to said base, sa middle segment having upper and lower cammi surfaces and an enlarged central bore; and, upper and lower segments engaging said upper a lower camming surfaces, respectively; and, the fastener screw thread means extends downward through the upper segment, through the enlarg central bore of the middle segment, and engag the lower segment to draw the upper and low segments together when the screw thread means advanced.

15. The apparatus of claim 13 wherein:

the segments of the fastening mechanism are taper rearwardly for use with a back gauge having pered fingers.

* * * * *